US010563490B2

(12) United States Patent
Ladron de Guevara Rangel

(10) Patent No.: US 10,563,490 B2
(45) Date of Patent: Feb. 18, 2020

(54) MECHANICAL PUMPING HYDRAULIC UNIT

(76) Inventor: Alejandro Ladron de Guevara Rangel, Suba (CO)

( * ) Notice: Subject to any disclaimer, the term of this patent is extended or adjusted under 35 U.S.C. 154(b) by 71 days.

(21) Appl. No.: 13/880,734

(22) PCT Filed: Aug. 5, 2011

(86) PCT No.: PCT/IB2011/001815
§ 371 (c)(1),
(2), (4) Date: Apr. 21, 2013

(87) PCT Pub. No.: WO2012/052813
PCT Pub. Date: Apr. 26, 2012

(65) Prior Publication Data

US 2013/0209285 A1 Aug. 15, 2013

(30) Foreign Application Priority Data

Oct. 21, 2010 (CO) ..... 10-130183

(51) Int. Cl.
*E21B 43/12* (2006.01)
*F04B 47/04* (2006.01)
(Continued)

(52) U.S. Cl.
CPC ..... *E21B 43/126* (2013.01); *F04B 47/04* (2013.01); *F04B 17/03* (2013.01); *F04B 23/04* (2013.01); *F15B 2211/62* (2013.01)

(58) Field of Classification Search
CPC ..... F04B 39/06; F04B 53/08; F15B 2211/62; F15B 2211/611; F15B 21/042; F16H 61/4165
See application file for complete search history.

(56) References Cited

U.S. PATENT DOCUMENTS 2,754,381 A * 7/1956 Martin ..... G01F 9/005 174/152 R
3,281,155 A * 10/1966 Kauffman ..... F16L 5/022 174/151
(Continued)

FOREIGN PATENT DOCUMENTS

ES 2314009 3/2009
GB 534943 3/1941
(Continued)

OTHER PUBLICATIONS

International Search Report issued in corresponding PCT Application No. PCT/IB2011/001815 dated Dec. 13, 2011.

*Primary Examiner* — Thomas E Lazo
*Assistant Examiner* — Michael Quandt
(74) *Attorney, Agent, or Firm* — Cotman IP Law Group, APLC

(57) ABSTRACT

The present invention relates to an improved mechanical pumping hydraulic unit for use in oil production or hydrocarbon extraction. The unit is characterized in that it has one motor (1-25), which activates a dual pump (1-15) at one end of the shaft and activates a fan (1-26) at the opposite end of the same shaft. The dual pump (1-15) provides power to the hydraulic power circuit (1-13) and to the hydraulic recirculation circuit (1-14). The motor (1-25), along with the pump (1-15) and the fan (1-26), are inside a metal structure (1-8), or focusing element, which serves to propel air sent by the fan (1-26) through the radiator (1-14-3) and to protect all the components of said unit, such as a tank (1-3) for the hydraulic oil, a compartment or casing for the electrical components (1-5), and a component or dry chamber (1-2) for the hydraulic instrument panel (1-7).

9 Claims, 8 Drawing Sheets

(51) Int. Cl.
*F04B 17/03* (2006.01)
*F04B 23/04* (2006.01)

(56) References Cited

U.S. PATENT DOCUMENTS

| | | | | | |
|---|---|---|---|---|---|
| 3,487,431 | A | * | 12/1969 | Forkner | 417/410.1 |
| 3,708,977 | A | * | 1/1973 | Raymond | 60/453 |
| 4,114,375 | A | * | 9/1978 | Saruwatari | F03C 1/007 417/904 |
| 4,198,820 | A | | 4/1980 | Roth et al. | |
| 4,512,149 | A | | 4/1985 | Weaver | |
| 4,530,645 | A | * | 7/1985 | Whatley | F04B 47/04 417/399 |
| 4,926,723 | A | * | 5/1990 | Lothammer | B23Q 3/16 82/118 |
| 6,524,084 | B2 | * | 2/2003 | Neumair | 417/372 |
| 6,592,336 | B1 | * | 7/2003 | Hirano | F04B 17/03 417/201 |
| 7,448,858 | B2 | * | 11/2008 | Neumair et al. | 417/410.1 |
| 8,083,499 | B1 | * | 12/2011 | Krug | E21B 43/126 417/390 |
| 2007/0068151 | A1 | | 3/2007 | Dong et al. | |

FOREIGN PATENT DOCUMENTS

| | | |
|---|---|---|
| GB | 542690 | 1/1942 |
| JP | 57140904 | 8/1982 |

* cited by examiner

5/8

MECHANICAL PUMPING HYDRAULIC UNIT

FIELD OF THE INVENTION

The present invention is a mechanical pumping hydraulic unit completed for its use in the production of petroleum or the extraction of hydrocarbons. In the oil industry, the need for varying the distance travelled by the hydraulic actuator, in addition to being able to vary the downward speed independently from the upward speed, is well-known. This invention causes a variation in the number of cycles the machine completes per minute without the need for electronic frequency drivers, given that the aforementioned speed variations are a result of the variation of the flow entering or leaving the hydraulic actuator through the use of flow control valves. This fact reduces the operating costs for the artificial lift system and increases well production. Therefore, this invention is applicable for use in oil wells where a mechanical pumping unit is used as the system for artificial lift.

BACKGROUND OF THE INVENTION

Mechanical pumping hydraulic units are machines that carry out the artificial lift of the petroleum which is below ground by using a hydraulic system comprised of a set of independent elements. Usually, three motors are used: one for the power pump, another for the recirculating pump and another for a fan. In addition, these machines have an oil tank, an electrical compartment, a focusing element for the air that the fan generates, and a structure in which all the previously mentioned components are housed. This invention simplifies the design and optimizes the operation of the conventional pumping unit, given that it only uses one motor to operate both pumps and the fan. What is more, its physical structure contains the hydraulic tank, the electrical compartment, and the focusing element, resulting in a more reliable and simple machine.

OBJECT OF THE INVENTION

The invention corresponds to a mechanical pumping hydraulic unit, which has a hydraulic power unit, a pedestal and a hydraulic actuator. This unit has a single motor that provides power to all the unit's elements. Said invention works when the first pump of a dual pump, which is in the hydraulic power unit, takes hydraulic oil from the hydraulic oil tank and sends it in a flow and under pressure to the hydraulic actuator, which is at the top of the pedestal. Thus, the hydraulic actuator lifts the load necessary to put an oil well in production. When the movement of lifting the load is completed, the hydraulic power unit activates its solenoid valve to change and thus allow the hydraulic actuator to return to its initial position in order to begin a new cycle. The action of the solenoid valve changing, activated by the hydraulic power unit, is determined by two track limits which are located on a pedestal: one at the upper end and one at the lower. At the same time, the second pump of the dual pump sends hydraulic oil to a filter, which it takes from the hydraulic oil tank, and then passes it through a radiator with the aim of cooling it. Finally, the oil, now clean from impurities, returns to the hydraulic oil tank at a lower temperature to that at which it went out, with the aim of maintaining a stable and optimum temperature throughout the system. At the same time the electric motor has a through shaft in which a metallic fan is mounted at the rear, which provides the flow of air necessary to cool the oil that passes through the radiator. In this way, the design of a mechanical pumping hydraulic unit is optimized, given that with a single motor the power pump (primary pump), the circulation pump (secondary pump) and the fan are powered, all of which being components that are coupled directly to the motor shaft.

DESCRIPTION OF THE FIGURES

FIG. 8*b*: Cross-section view of the hydraulic actuator of the mechanical pumping hydraulic unit.

REFERENCE LIST

Figure 1A:
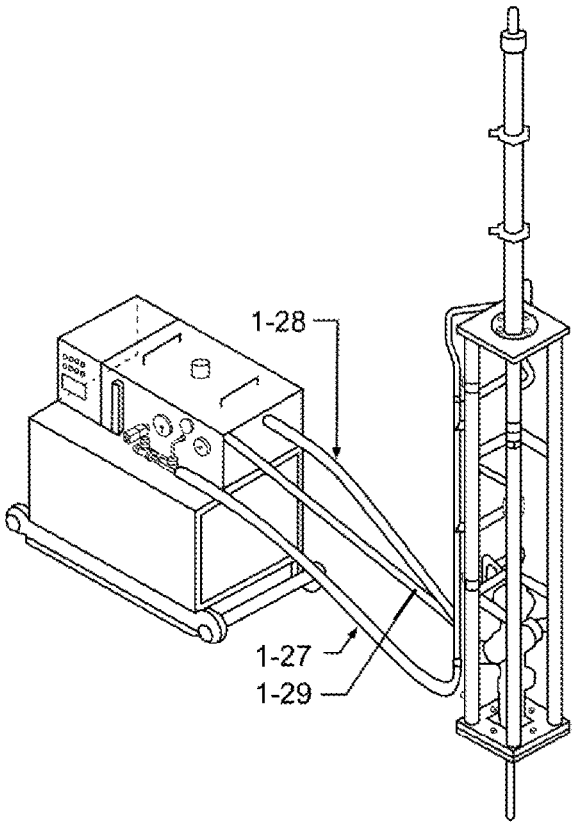
FIG. 1*a*: Isometric view of the mechanical pumping hydraulic unit.

1. Hydraulic power unit.
1-1. Step.
1-2. Dry chamber.
1-2-1. Bushing for the o-ring.
1-3. Hydraulic oil tank.
1-4. Tray for the star triangle starter.
1-5. Electrical component compartment.
1-6. Electrical instrument panel.
1-7. Hydraulic instrument panel
1-8. Compact structure or focusing element.
1-9. Elevated base.
1-10. Skid.
1-11. Electrical connection duct.
1-12. Support for the hydraulic circuit.
1-13. Hydraulic power circuit.
1-13-1. Check.
1-13-2. Piloted pressure control valve.
1-13-3. Solenoid valve.
1-13-4. Flow control check valve.
1-13-5. Tee coupling
1-13-6. Shutoff valve.
1-13-7. High pressure manometer.
1-13-8. Hose and accessories that connect the primary outlet of the dual pump with the check.

1-13-9. Connection duct between the filter and the high-pressure manometer.

1-14. Recirculation hydraulic circuit.

1-14-1. Hydraulic oil filter.

1-14-2. Low-pressure manometer.

1-14-3. Radiator.

1-14-4. Hose and accessories that connect the filter to the radiator.

1-14-5. Hose and accessories that connect the radiator to the hydraulic oil tank.

1-14-6. Connection duct between the second outlet of the dual pump and the low-pressure manometer.

1-15. Dual pump.

1-16. Hose, filter and accessories for the suction point of the dual pump.

1-17. Bell.

1-18. Flexible coupling.

1-19. Level viewfinder.

1-20. Filling cap.

1-21. Thermometer.

1-22. Cover for the electrical compartment.

1-22-1. Seal for the electrical compartment cover.

1-23-1. Seal for the hydraulic oil tank cover.

1-24. Protective grill.

1-25. Electric motor.

1-26. Fan.

1-27. Motor oil hose.

1-28. Return hose for the hydraulic oil.

1-29. Signal cable for the track limits between the pedestal (2) and the hydraulic power unit (1).

2. Pedestal.

2-2. Base for the tower-type structure.

2-3. Upper track limit.

2-4. Lower track limit.

2-5. Power hose between the pedestal (2) and the hydraulic actuator (3).

2-6. Return hose between the hydraulic actuator (3) and the pedestal (2).

2-7. Bracket for the track limit sensors.

2-8. Connection cable for the track limit sensors.

2-9. Cable glands for the connection cable.

3. Hydraulic actuator.

3-1. Upper cover.

3-2. Piston.

3-3. Piston rod.

3-4. Hydraulic casing.

3-4-1. Internal cone of the hydraulic casing.

3-4-2. Hydraulic casing plate.

3-5. Lower cover.

3-6. Coupling between the piston rod (3-3) of the hydraulic actuator (3) and the polished rod of the well.

3-7. Tubular system for the oil return with brackets to the hydraulic casing.

3-8. Return hose between the hydraulic actuator (3) and the tubular system for the oil return with brackets to the hydraulic casing (3-7).

DETAILED DESCRIPTION OF THE INVENTION

The present invention is a mechanical pumping hydraulic unit that supplies the flow of hydraulic oil at the required pressure to work a hydraulic actuator (3), which in turn is able to lift the weight generated by the rod string from the well and the hydrostatic column created by the petroleum when it is being extracted. This invention is characterized by having only one motor (1-25), which powers a dual pump (1-15) at one of the extremes of the shaft, and which, at the opposite end of the shaft, powers a fan (1-26). The motor (1-25), together with the pump (1-15) and the fan (1-26), are inside a metallic structure, or focusing element (1-8), which directs the air from the fan (1-26) through the radiator (1-14-3) or oil-air heat interchanger, with the aim of cooling the oil. The hydraulic power unit (1) has a tank (1-3) for the hydraulic oil, a compartment or box which houses the electrical components (1-5), a dry compartment or chamber (1-2) for the hydraulic instrument panel (1-7), and it is mechanically connected to a skid (1-10) at its base. Said hydraulic power unit (1) has the following functions:

a. to protect the motor (1-25), the pump (1-15), the bell-type coupling system (1-17) between the pump and the motor, the radiator (1-14-3), the fan (1-26), and some of the elements belonging to the hydraulic system, such as hoses and screw fittings, from the environment (water, sun).

b. to serve as a focusing element (1-8) for the air created by the fan (1-26), making it pass through the radiator (1-14-3).

c. to serve as a storage tank (1-3) for the hydraulic oil.

d. to serve as a housing for the electrical components.

e. to serve as a console for the hydraulic instrument panel (1-7), and for the electrical instrument panel.

The mechanical pumping hydraulic unit works in the following way: once the motor (1-25) is started, it activates the fan (1-26) and the dual pump (1-15) that is coupled to the shaft. Both components of the dual pump (1-15) use the same suction to take oil from the hydraulic tank (1-3) by way of a suction filter, a ball-type valve, and hoses and accessories (1-16) above the pump, thus providing a positive suction head to said dual pump (1-15). The first pump, or power pump, sucks a larger quantity of oil than the second pump and exerts enough pressure so that the hydraulic actuator (3) lifts the weight generated by the rod string and the hydrostatic column. At the same time, the second pump, or recirculation pump, takes a flow of hydraulic oil and sends it through a hydraulic oil filter (1-14-1). It then sends it through the radiator (1-26), returning said oil to the tank (1-3) at a lower temperature to that which it went out of the tank, and with fewer contaminant particles. Throughout the whole process, the fan (1-26) propels air through the radiator (1-14-3), aided by the focusing element (1-8) in the hydraulic power unit (1), with the aim of supplying a fluid that removes the excess heat present in the hydraulic oil. This process is carried out with the aim of maintaining a thermal balance in the interior of the machine, since an imbalance would cause deterioration of the seals for the hydraulic components and the hydraulic oil itself, resulting in multiple leaks and faults.

Looking at the machine from another angle, the unit has two independent hydraulic circuits. The first circuit is the hydraulic power circuit (1-13), where the flow control valve (1-13-4), the piloted pressure control valve (1-13-2), the solenoid valve (1-13-3), a check (1-13-1), a cut-off valve (1-13-6), a tee coupling (1-13-5), and a high-pressure manometer (1-13-7) are housed. With these components, the hydraulic power circuit (1-13) controls the necessary pressure and flow to move the hydraulic actuator (3). The second hydraulic circuit is for recirculation (1-14), where the filter (1-14-1), the radiator (1-14-3), and the low-pressure manometer (1-14-2) are housed, and is helped by the fan (1-26). The purpose of this second hydraulic circuit is to maintain optimum working conditions of the oil, since contaminant particles, such as dust, are extracted by the filter (1-14-1), and the heat generated in the first hydraulic circuit is extracted by the radiator (1-14-3) and the fan (1-26).

Figure 1B:
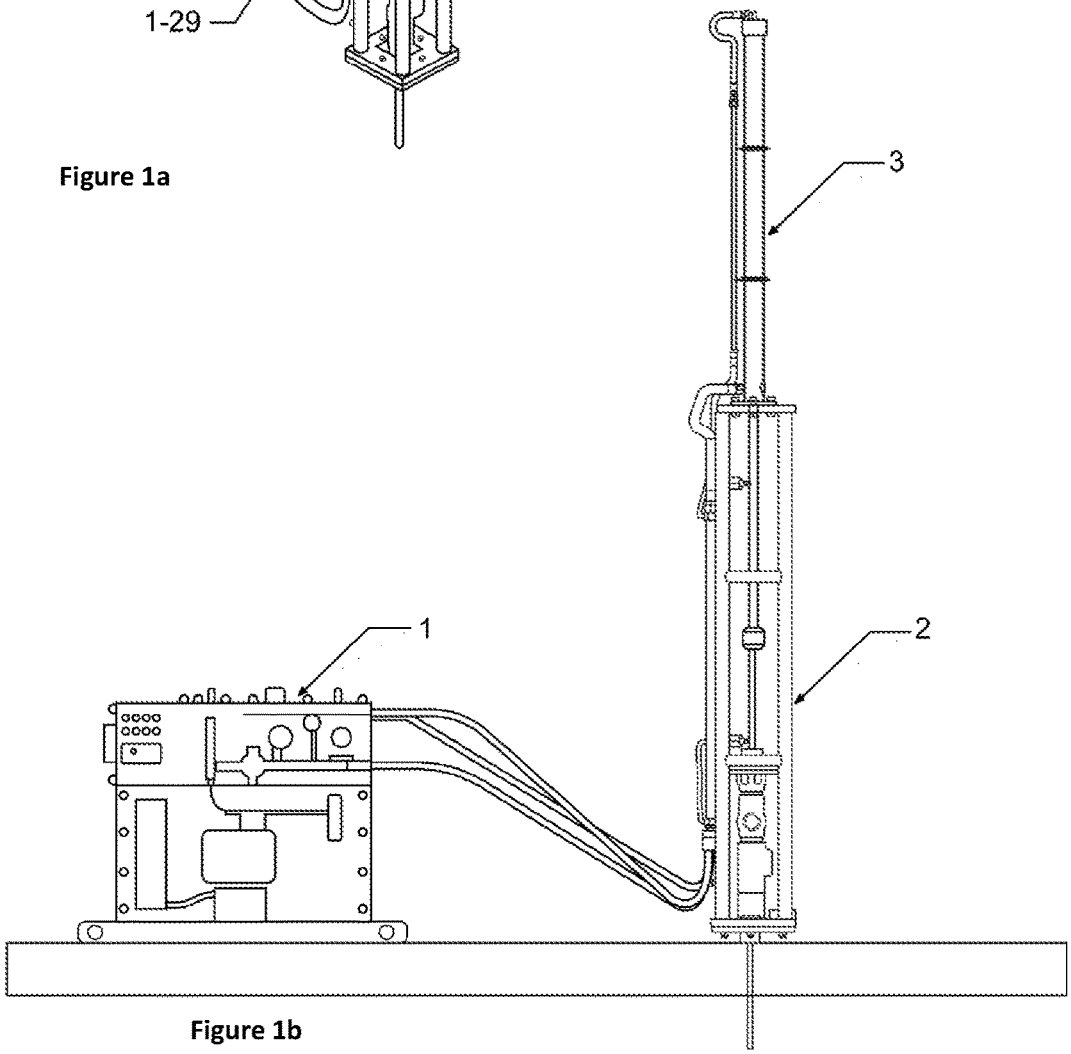
FIG. 1*b*: Front view of the mechanical pumping hydraulic unit.

FIG. 1 shows the structural form of the hydraulic power unit (1), the pedestal (2), the hydraulic actuator (3), the hydraulic hoses (1-27, 1-28), and the cable (1-29) belonging to the track limit sensors.

All these components combined create what we have named: THE MECHANICAL PUMPING HYDRAULIC UNIT.

Figure 2:
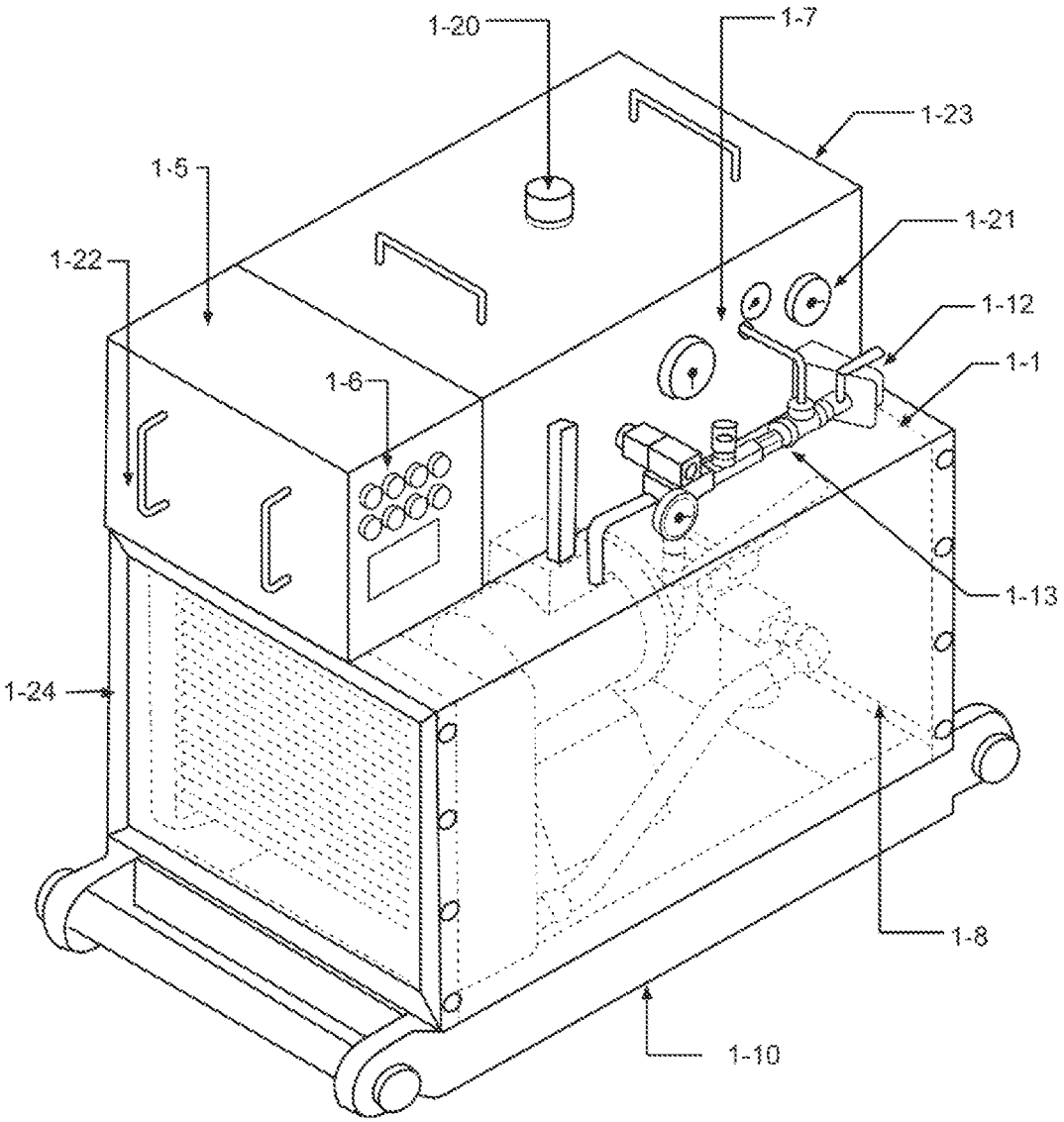
FIG. 2: Isometric view of the hydraulic power unit.
Figure 3A:
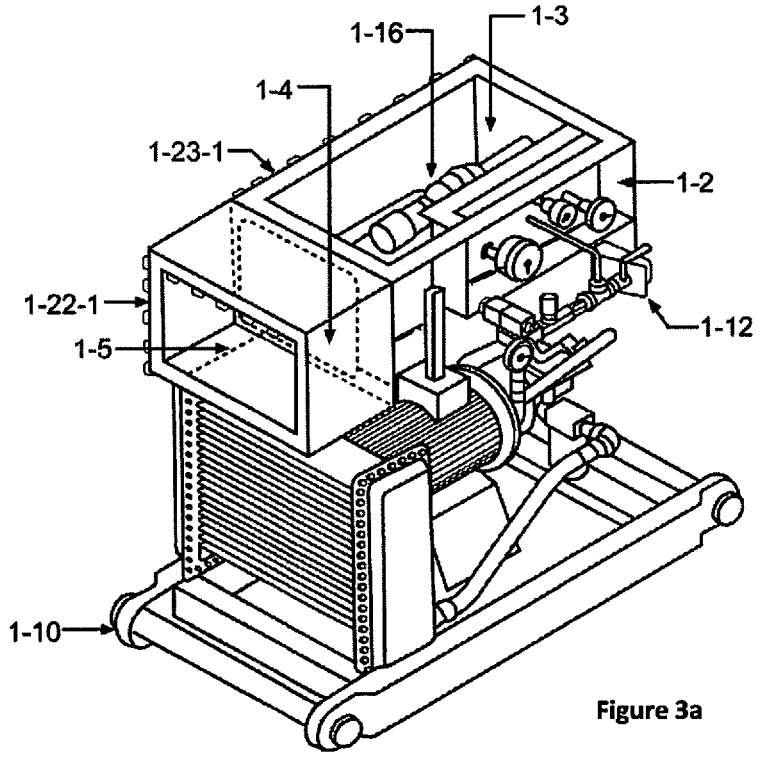
FIGS. 3*a* and 3*b*: Isometric views of the internal parts of the hydraulic power unit with the tank and skid.
Figure 3B:
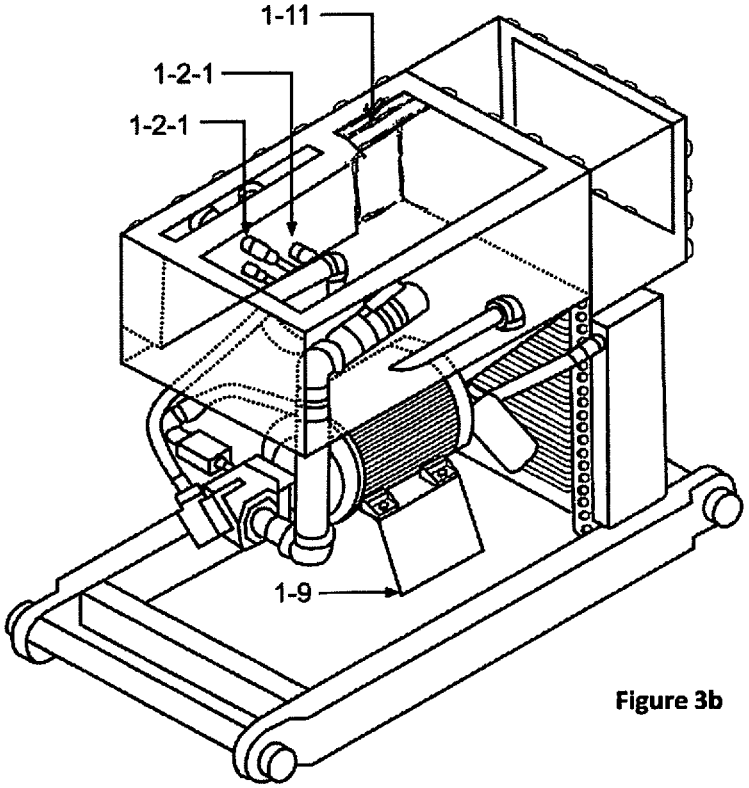

The details of the hydraulic instrument panel (1-7), the electrical instrument panel (1-6), the electrical components compartment (1-5), the focusing element (1-8), the skid (1-10), and a step (1-1) where the hydraulic power circuit (1-13) is located can be seen In FIG. 2. The hydraulic instrument panel (1-7) is in front of the hydraulic oil tank (1-3). This hydraulic instrument panel (1-7) is comprised of two manometers (1-13-7, 1-14-2) and a thermometer (1-21). The first manometer (1-13-7), from left to right, registers the operating pressure of the machine. The second manometer (1-14-2), or the low-pressure manometer, registers the pressure before the hydraulic oil filter (1-14-1), with the aim of identifying when the filter becomes blocked. The thermometer (1-21) registers the temperature of the oil inside the tank (1-3). In addition, FIG. 2 shows a level viewfinder (1-19) in the hydraulic oil tank (1-3), the cover of the electrical compartment (1-22), the protective grill (1-24) of the radiator (1-14-3), the support for the hydraulic circuit (1-12), the hydraulic circuit (1-13), the skid (1-10) and the filling lid (1-20) on top of the hydraulic oil tank (1-23).

Due to the fact that the fan (1-26) has a larger diameter than the electric motor (1-25) and that these components are coupled in a concentric way, it is necessary to install a motor (1-25) over an elevated base (1-9), thus avoiding that the fan blades (1-25) hit the ground. This characteristic can be seen in FIGS. 3*a*, 3*b*, 4*a* and 4*b*.

Inside the electrical component compartment (1-5) is the tray (1-4) for the electrical components, which is connected to the inside of said compartment (1-5) by four screws. Given that the compartment (1-5) shares the back wall with the hydraulic oil tank (1-3), a temperature sensor and a level sensor have been installed in the wall, thus avoiding external connections with the electrical compartment (1-5) and simplifying even more the design of the machine described here. These characteristics can be seen in FIG. 3*a*.

There is an electrical conduction duct (1-11) which is between the electrical compartment (1-5) and the dry chamber (1-2), the purpose of which is to act as a passageway for the solenoid valve cables, as well as the cables belonging to the track limit sensors installed in the pedestal. With this design we have managed to keep all the electrical connections of the machine contained within it. Its position be seen in FIG. 3*b*.

The dry chamber (1-2) is a space defined by folded and soldered metal sheets in front of the hydraulic oil tank (1-3). This chamber keeps the hydraulic oil out of contact with the manometers (1-13-7, 1-14-2) and the thermometer (1-21). The solenoid cables and those of the track limits also pass through this chamber. The position of this chamber can be seen in the 3D drawing FIG. 3*a*.

Figure 4A:
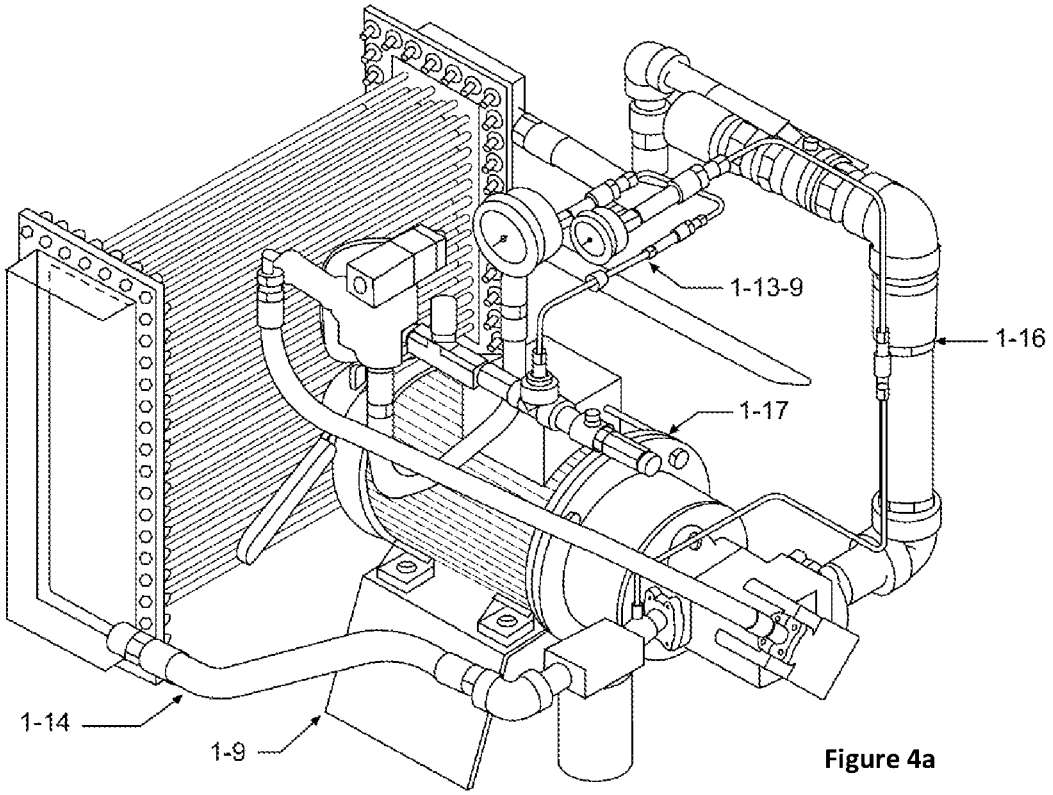
FIG. 4*a*: Isometric view of the internal parts of the hydraulic power unit.
Figure 4B:
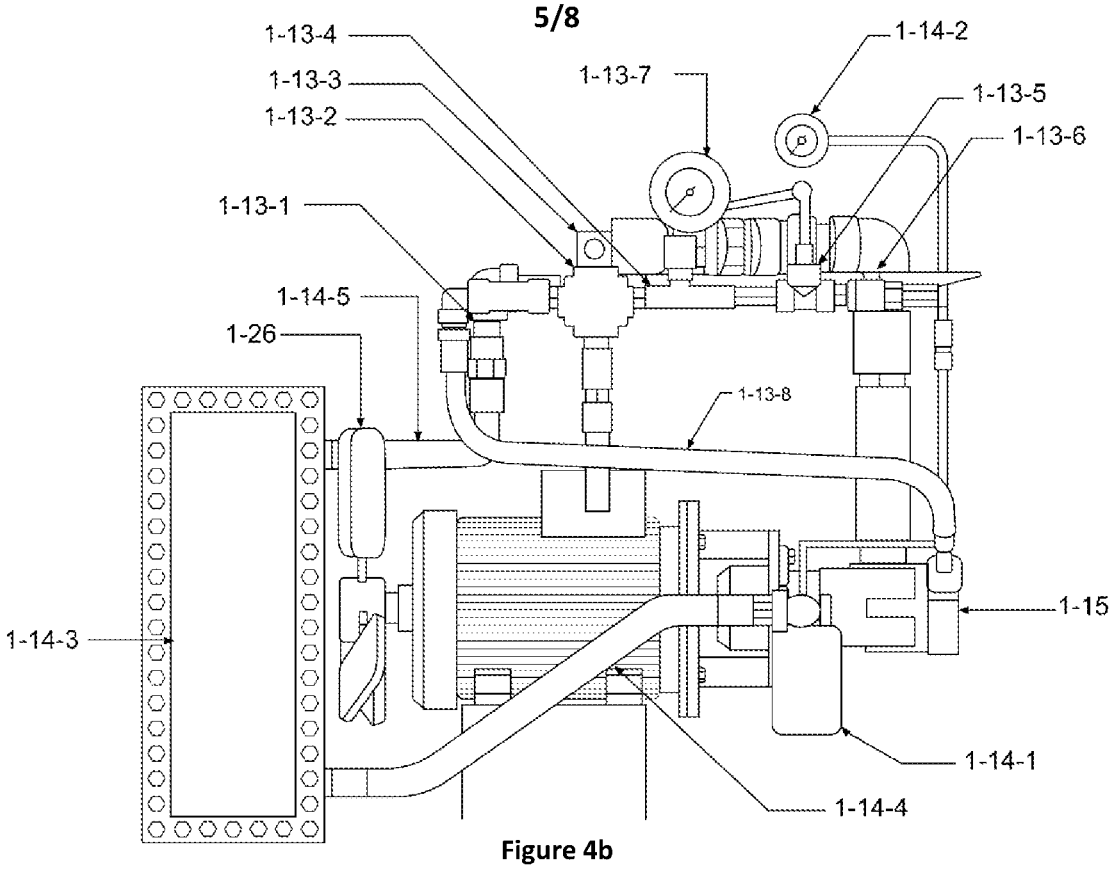
FIG. 4*b*: Front view of the internal parts of the hydraulic power unit.

FIGS. 4*a* and 4*b* show the hydraulic connections that are inside the hydraulic power unit. First, we can see that the dual pump (1-15) has one hydraulic oil suction point (1-16), which, in turn, has a valve, a filter, and several kinds of connectors and accessories.

The way the hydraulic oil filter is connected to the first outlet of the dual pump can also be seen, and how a hose comes out of the filter with several accessories and is connected to the radiator (1-13-3). Another hose comes out of the radiator (1-13-3), which is connected to the return hose to the hydraulic oil tank (1-3), via a set of accessories and connectors. Second, we can see how the power circuit (1-13) is built. The circuit begins with a hose that comes out of the second outlet from the dual pump (1-5) and connects to a check (1-13-1), followed by the pressure control valve (1-13-2) and the flow control valve (1-13-4). In the pressure control valve (1-13-2) is the return to the tank, in the form of a hose with several accessories and a solenoid valve (1-13-3) which changes the pressure control valve (1-13-2) between the maximum pressure for operating the mechanical pumping hydraulic unit and 0 PSIG. Finally, it is important to mention that both the power circuit (1-13) and the recirculation circuit (1-14) each have a manometer, which are connected to their respective circuits with tubing and special high-pressure connectors. The purpose of the manometer (1-13-7) installed in the power circuit (1-13) is to register the pressure with which the hydraulic actuator (3) lifts the load in order to assess the activity of the well. The purpose of the manometer (1-14-2) installed in the recirculation circuit (1-14) is to identify the moment in which the hydraulic oil filter (1-14-1) begins to get blocked in order to program a filter change.

Figure 5A:
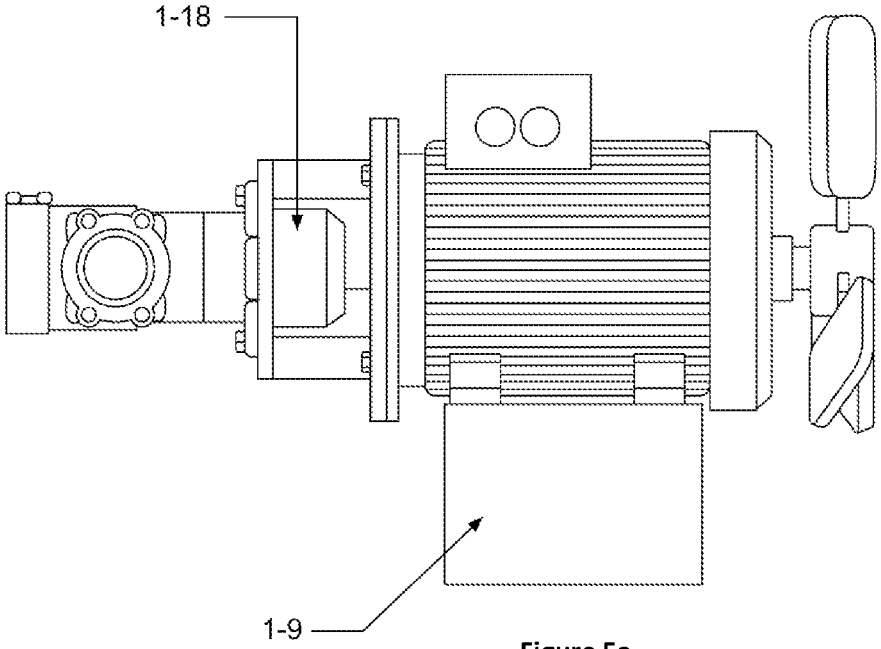
FIG. 5*a*: Front view of the power system for the hydraulic power unit.
Figure 5B:
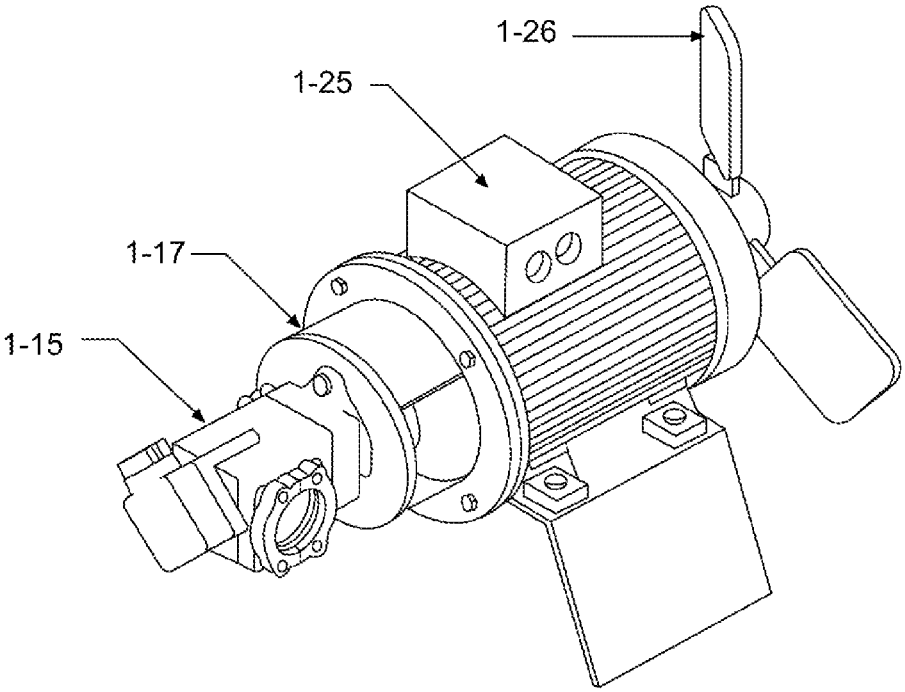
FIG. 5*b*: Isometric view of the power system for the hydraulic power unit (fan, motor, bell, flexible coupling, hydraulic pump).

FIG. 5*b* shows the power system in detail. This is the heart of the machine and where the motor (1-25), the fan (1-26), the bell (1-27), the flexible coupling (1-18) and the dual pump (1-15) are housed. What characterizes this machine is that the previously mentioned components are all installed inside the motor shaft, and it was designed in this way so that a single motor would move:

1. the oil that is used to lift the load of the hydraulic actuator (3);
2. the oil that cools the machine; and
3. the air the cools the machine when it passes through the radiator (1-14-3).

This characteristic is only achieved by using a motor with a through shaft, given that at one end of the shaft is the fan (1-26), and at the other is the dual pump (1-15), with its respective bell (1-17) and flexible coupling (1-18).

Figure 6A:
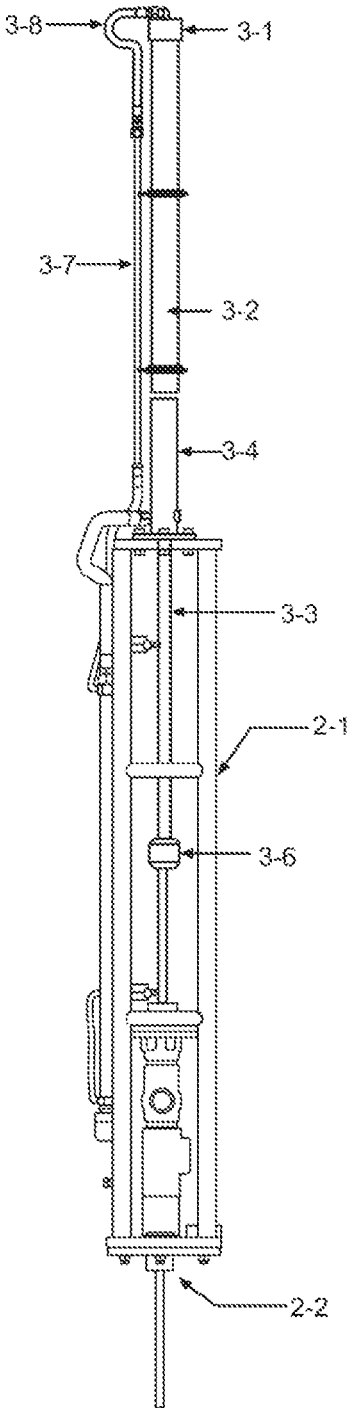
FIG. 6*a*: Front view of the hydraulic actuator and the pedestal of the hydraulic mechanical pumping unit.

FIG. 6*a* shows how the hydraulic actuator (3), and the pedestal (2) are assembled. The pedestal has a tower-type structure (2-1), a base (2-2) for said structure, an upper limit track sensor (2-3), a lower limit track sensor (2-4), a power hose (2-5), a return hose (2-6), two brackets (2-7) for the track limit sensors (2-3, 2-4), connection cables (2-8) for the track limit sensors (2-3, 2-4), and several cables glands (2-9) for the connection cable (2-8).

Figure 6B:
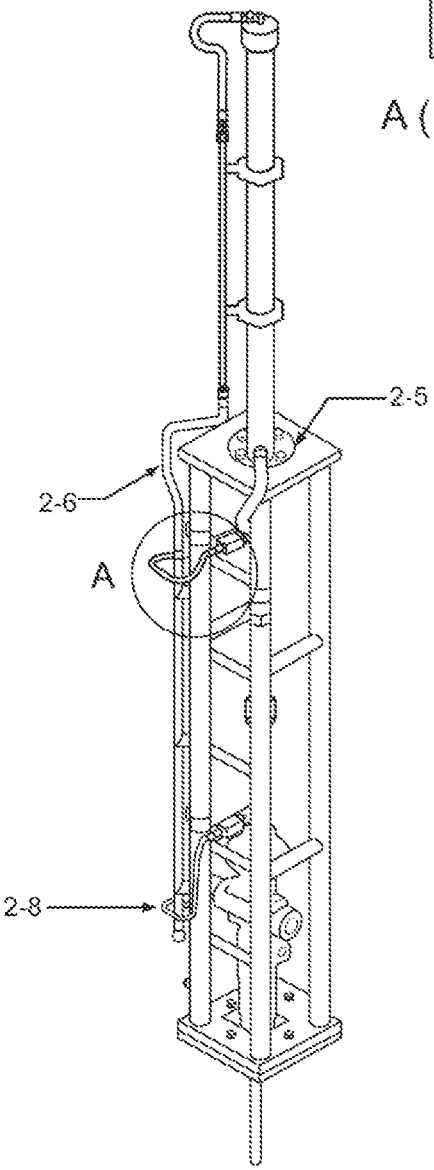
FIG. 6*b*: Isometric view of the hydraulic actuator and the pedestal of the mechanical pumping hydraulic unit.
Figure 6C:
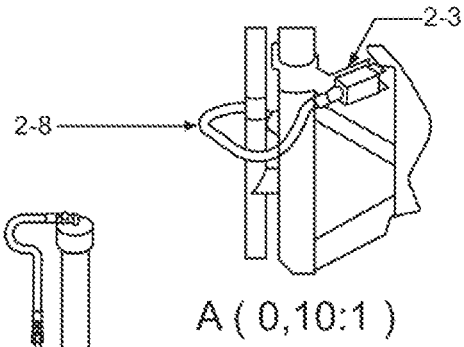
FIG. 6*c*: Track limit detail.

The base (2-2) of the pedestal (2) has a screw-type connection that is placed above the well head, and below the tee coupling are the BOP and the cable glands, as can be seen in FIG. 6*b*. The three previously mentioned parts are not components of the mechanical pumping hydraulic unit as they form part of the standard completion in oil wells that use mechanical pumps as the artificial lift system. The tower-type structure (2-1) is mounted on the base (2-2) concentrically, and the hydraulic actuator (3) is mounted on the tower-type structure (2-1) in the same way.

Figure 7A:
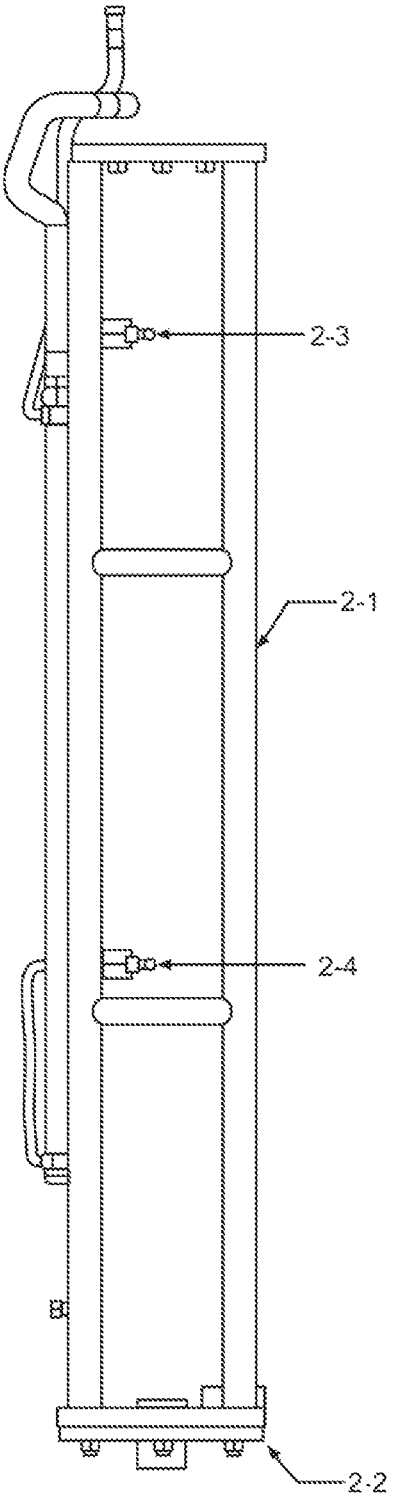
FIG. 7*a*: Front view of the pedestal of the mechanical pumping hydraulic unit.
Figure 7B:
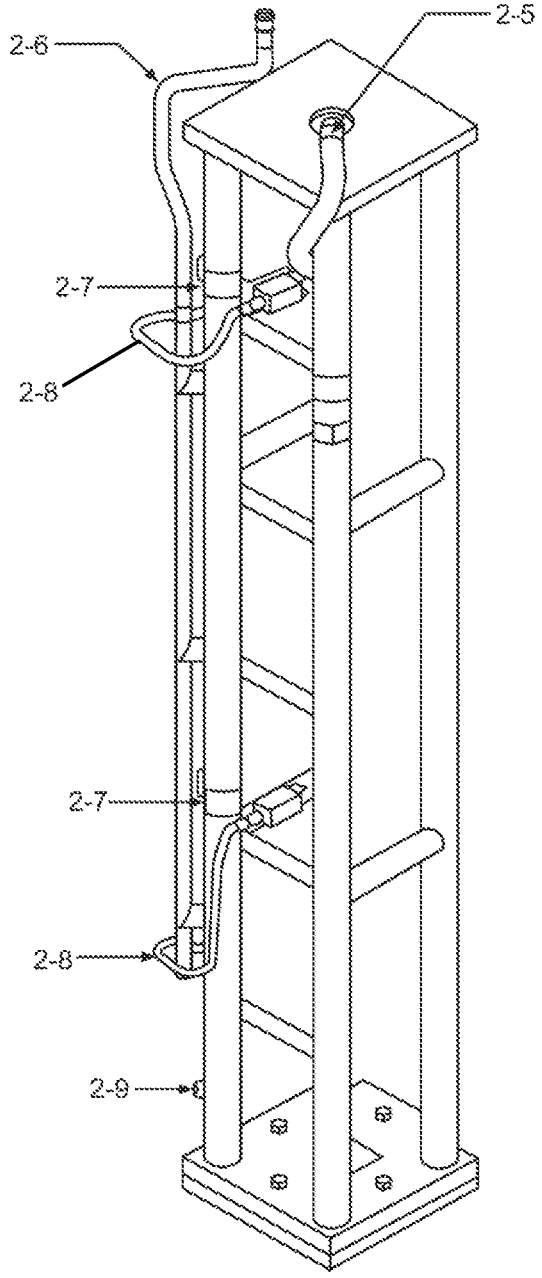
FIG. 7*b*: Isometric view of the pedestal of the mechanical pumping hydraulic unit.

FIG. 7*b* shows in detail the structure of the pedestal (2). It is important to mention that the pedestal (2) structure includes a ladder to allow an operator to climb it and calibrate the upper limit track sensor (2-3) or to carry out maintenance. There are also two parallel pipes on either side of the ladder through which the hydraulic oil goes up or down. The purpose of these pipes is to provide support for the hoses that go into and come out of the pedestal (2), and also to reduce the length of said hoses.

Figure 8A:
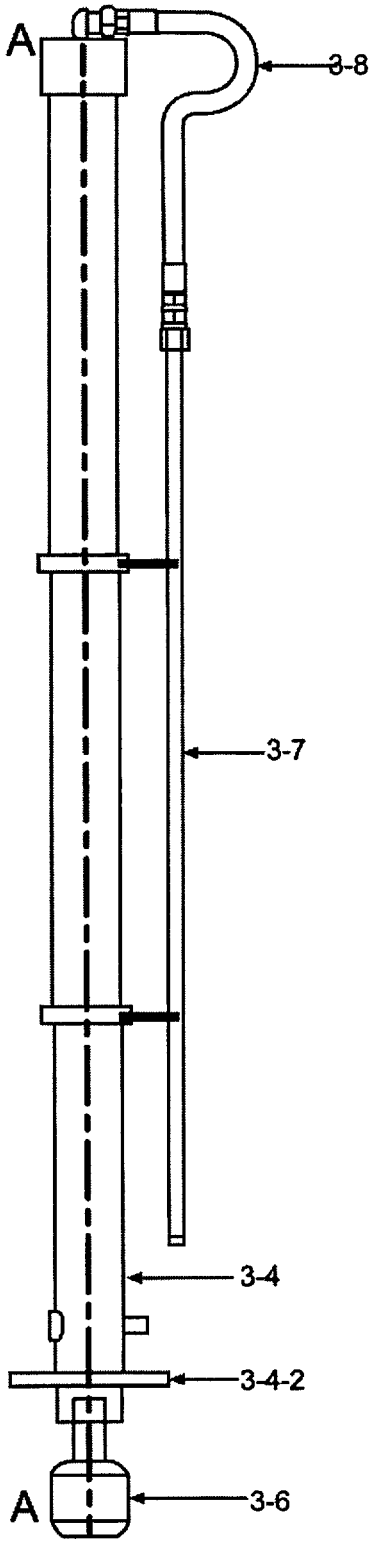
FIG. 8*a*: Front view of the hydraulic actuator of the mechanical pumping hydraulic unit.
Figure 8C:
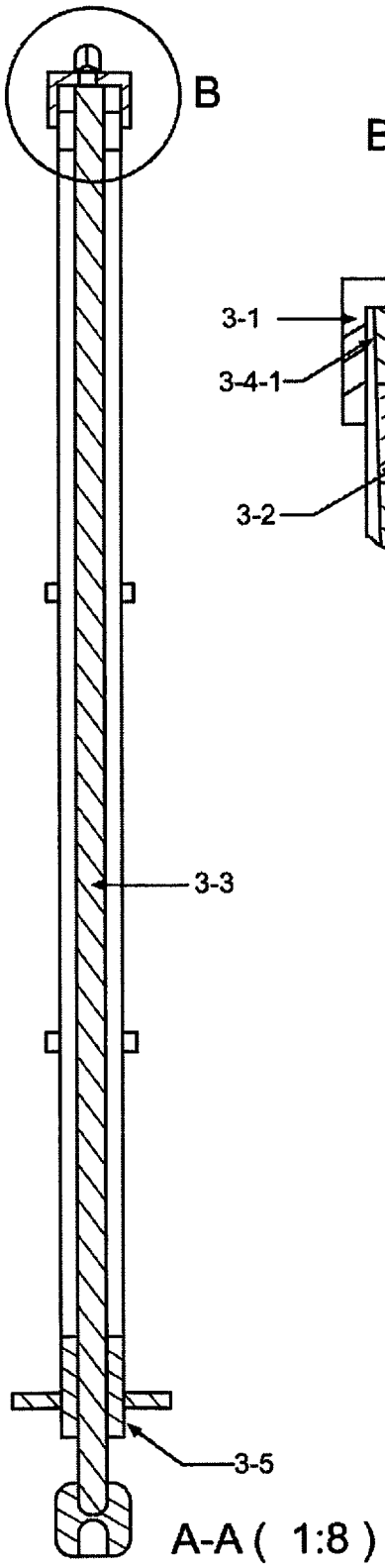
FIG. 8*c*: Detail of the internal cone.
Figure 8C:
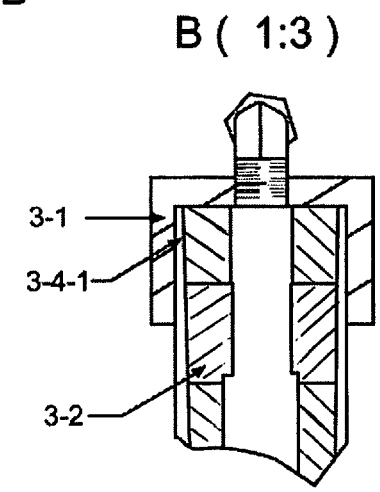

FIGS. 8*a*, 8*b* and 8*c* show in detail the structure of the hydraulic actuator (3). We can see that the hydraulic actuator (3) is comprised of: a top cover (3-1), a piston (3-2), a piston rod (3-3), a hydraulic casing (3-4), a bottom cover (3-5), a coupling between the piston rod (3-3) of the hydraulic actuator (3) and the polished rod of the well, a tubular oil return system (3-7) with brackets attached to the hydraulic casing, and a return hose between the top cover (3-1) of the hydraulic actuator (3) and the tubular oil return system (3-7). What characterizes the design of this hydraulic actuator (3) is the fact that its inner upper part, in the hydraulic casing (3-4), is cone-shaped (3-4-1). This, in conjunction with the cover (3-1) that screws onto the exterior diameter of the hydraulic casing (3-4), allows the piston (3-2) to enter through the top end of the hydraulic casing (3-4). This design detail is important because when the piston (3-2) is assembled inside the hydraulic casing (3-4), the seal placed inside the grooves of the hydraulic casing (3-4) expands and needs a cone shape that begins with the larger diameter and reduces in size to the optimal diameter for operation, without the seal touching sharp threads, such as the fillets of screw-type fittings, during this process. It is for this last reason that the nut that connects the hydraulic casing (3-4) with the top cover (3-1) is placed in the diameter exterior of the hydraulic casing (3-4).

The invention claimed is:

1. A mechanical pumping hydraulic unit comprising:

a single motor comprising a motor shaft coupled to a dual pump unit at a first end of said shaft and a fan at a second end of said shaft, wherein said dual pump unit is configured to receive hydraulic oil from a hydraulic oil tank;

a hydraulic power circuit coupled to a first pump of the dual pump unit;

a hydraulic recirculation circuit comprising a radiator, wherein the dual pump unit comprises a second pump configured to feed hydraulic oil from the hydraulic oil tank through the radiator in the hydraulic recirculation circuit, wherein said fan is configured direct air to cool the hydraulic oil in the radiator of the hydraulic recirculation circuit;

a hydraulic power unit housing comprising the single motor, the hydraulic recirculation circuit, the hydraulic power circuit and the dual pump unit; and a hydraulic actuator coupled to said hydraulic power circuit, wherein the hydraulic actuator comprises a vertical casing with a top cover, wherein said casing comprises a cone shaped upper section that begins with a larger diameter at a top end of the casing and narrowing down to a smaller diameter at bottom end of the cone shaped upper section and extending said smaller diameter to a bottom end of the casing, wherein said casing comprises a piston and a seal around said piston, wherein said piston is coupled to a piston rod that extends downwards through a lower cover to a free end of the piston rod that is configured for coupling to a polished rod of an oil well.

2. The mechanical pumping hydraulic unit of claim 1, wherein said hydraulic power unit housing also contains the hydraulic oil tank, a compartment or casing for electrical components including a signal cable, a solenoid valve cable, and a compartment or dry chamber for a hydraulic instrument panel.

3. The mechanical pumping hydraulic unit of claim 2, wherein electrical connections for the signal cable and the solenoid valve cable are contained within said hydraulic power unit housing.

4. The mechanical pumping hydraulic unit of claim 2, wherein said casing for the electrical components shares a back wall with the hydraulic oil tank.

5. The mechanical pumping hydraulic unit of claim 2, wherein said hydraulic instrument panel comprises a temperature sensor and a level sensor.

6. The mechanical pumping hydraulic unit of claim 1, wherein said hydraulic power unit housing contains a flow control check valve connected on one end to a piloted pressure control valve, wherein said piloted pressure control valve further comprises a solenoid valve, and wherein said piloted pressure control valve is also connected to a check valve, and wherein said flow control check valve is connected on a second end to a shutoff valve, through a tee coupling, having three ends, where a first end connects to the shutoff valve.

7. The mechanical pumping hydraulic unit of claim 3, wherein said hydraulic power unit housing contains a filter connected to the radiator through a hose and said filter is further connected to a low-pressure manometer.

8. The mechanical pumping hydraulic unit of claim 7, wherein said hydraulic power unit housing acts as a focusing element for the air from the fan.

9. The mechanical pumping hydraulic unit of claim 8, wherein said hydraulic power unit housing is mechanically connected to a skid at a base of the hydraulic power unit housing.

* * * * *